US006860056B2

(12) United States Patent
Howe

(10) Patent No.: US 6,860,056 B2
(45) Date of Patent: Mar. 1, 2005

(54) GUN SIGHT SYSTEM

(75) Inventor: Phillip D. Howe, Fort Collins, CO (US)

(73) Assignee: North Pass, Ltd., Fort Collins, CO (US)

( * ) Notice: Subject to any disclaimer, the term of this patent is extended or adjusted under 35 U.S.C. 154(b) by 28 days.

(21) Appl. No.: 10/443,529

(22) Filed: May 21, 2003

(65) Prior Publication Data

US 2004/0025398 A1 Feb. 12, 2004

Related U.S. Application Data

(60) Division of application No. 10/199,688, filed on Jul. 18, 2002, now Pat. No. 6,684,551, which is a continuation-in-part of application No. 10/038,128, filed on Jan. 2, 2002, now Pat. No. 6,678,987.

(51) Int. Cl.[7] ..... F41G 1/32
(52) U.S. Cl. ..... 42/132
(58) Field of Search ..... 42/111, 112, 123, 42/124, 132, 144, 145

(56) References Cited

U.S. PATENT DOCUMENTS

| | | | | | |
|---|---|---|---|---|---|
| 898,531 | A | | 9/1908 | Tufts | |
| 1,292,211 | A | * | 1/1919 | Young | 42/140 |
| 1,346,303 | A | * | 7/1920 | Dawson et al. | 42/145 |
| 2,706,335 | A | * | 4/1955 | Munsey | 42/145 |
| 2,970,380 | A | | 2/1961 | Hill | |
| 3,362,074 | A | * | 1/1968 | Luebkeman et al. | 42/144 |
| 3,678,590 | A | | 7/1972 | Hayward | |
| 3,698,092 | A | | 10/1972 | Rosenhan | |
| 3,886,667 | A | | 6/1975 | Rueb | |
| 4,536,965 | A | * | 8/1985 | Tildeblad | 42/132 |
| 4,745,686 | A | | 5/1988 | Willis | |
| 4,745,698 | A | | 5/1988 | Schwulst | |
| 5,279,061 | A | | 1/1994 | Betz et al. | |
| 5,560,113 | A | * | 10/1996 | Simo et al. | 33/265 |
| 5,638,604 | A | * | 6/1997 | Lorocco | 42/132 |
| 5,735,070 | A | | 4/1998 | Vasquez et al. | |
| 5,822,872 | A | | 10/1998 | Waki | |
| 5,862,618 | A | | 1/1999 | Brown | |
| 5,878,503 | A | * | 3/1999 | Howe et al. | 42/132 |
| 5,926,963 | A | | 7/1999 | Knight | |

(List continued on next page.)

FOREIGN PATENT DOCUMENTS

| | | | | |
|---|---|---|---|---|
| DE | 4214997 A1 | * | 11/1993 | F41G/1/02 |
| EP | 470016 A1 | * | 2/1992 | F41G/1/32 |
| FR | 2572802 A1 | * | 5/1986 | F41G/1/30 |

*Primary Examiner*—Jack Keith
*Assistant Examiner*—Troy Chambers
(74) *Attorney, Agent, or Firm*—Rob L. Phillips; Quirk & Tratos

(57) ABSTRACT

A gun sight system includes a front sight and a rear sight providing high shot accuracy and immediate target acquisition. Each sight having light-gathering means functions dependently defining a highly visible aiming point. An elongated light-gathering plastic rod retained on a front sight base member includes a triangular viewing surface. An oval-shaped light-gathering plastic rod, retained within a rear sight housing, includes two triangular shaped viewing surfaces disposed in a V-shaped void of the housing. From a user's perspective three lighted triangular shaped viewing ends of the light-gathering means define an aiming point and provide immediate target acquisition. Multi-colored light-gathering means and the creation of hot-spots further improve the present gun sight system.

8 Claims, 7 Drawing Sheets

U.S. PATENT DOCUMENTS 5,930,906 A * 8/1999 Howe et al. ..... 42/132
5,956,854 A * 9/1999 Lorocco ..... 42/132
6,014,830 A 1/2000 Brown et al.
6,035,539 A 3/2000 Hollenbach et al.
6,058,615 A 5/2000 Uhlmann et al.
6,058,616 A * 5/2000 Bubits ..... 42/144
6,122,833 A * 9/2000 Lorocco ..... 42/132
6,360,471 B1 3/2002 Stein
6,360,472 B1 * 3/2002 Lorocco ..... 42/132
6,421,946 B1 * 7/2002 LoRocco ..... 42/111
6,446,377 B1 * 9/2002 Hollenbach et al. ..... 42/148
6,678,987 B2 * 1/2004 Howe ..... 42/132
6,684,551 B2 * 2/2004 Howe ..... 42/132
2003/0121196 A1 * 7/2003 Howe ..... 42/132

* cited by examiner

FIG. 7
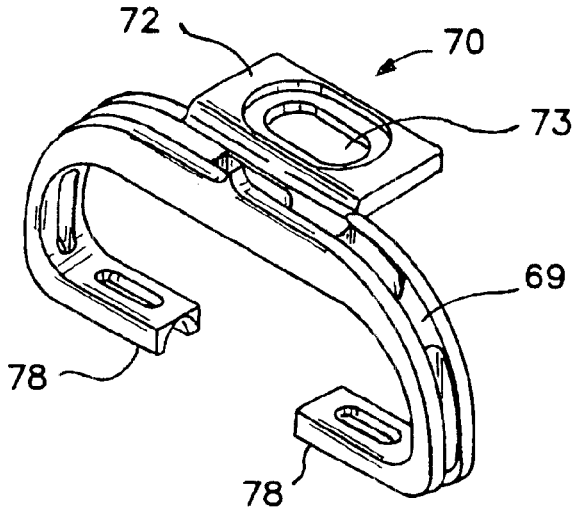
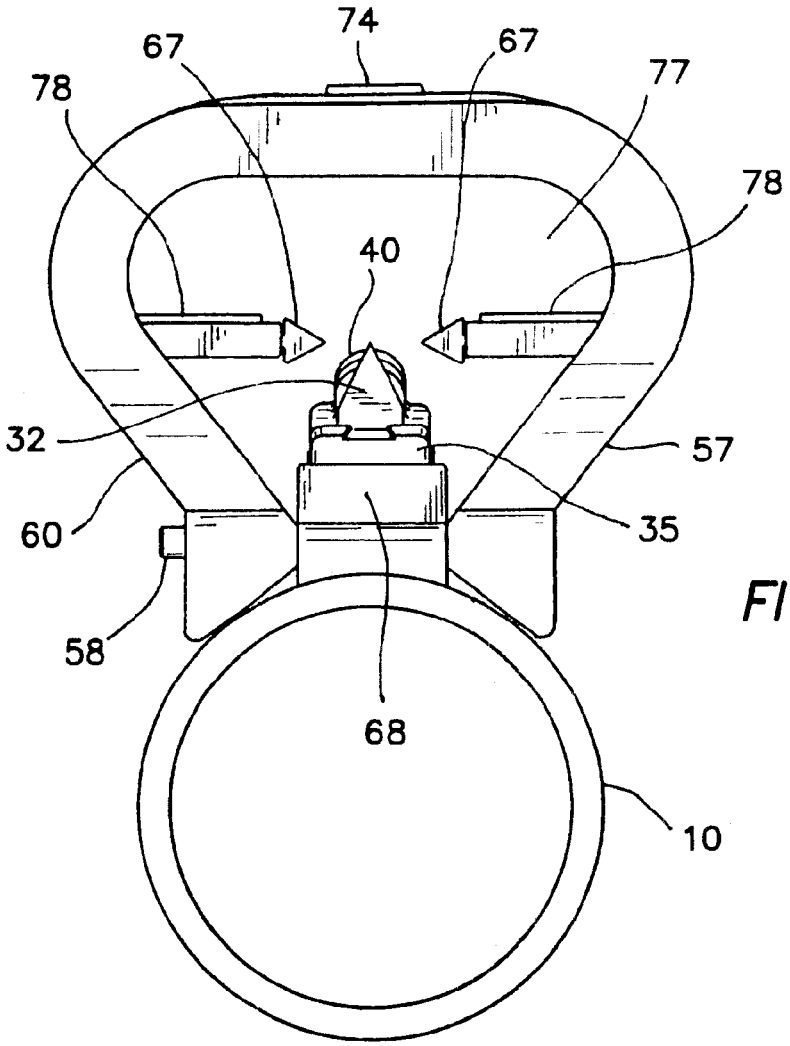
FIG. 8

GUN SIGHT SYSTEM

CROSS REFERENCE TO RELATED APPLICATIONS

This application is a divisional of application Ser. No. 10/199,688, filed Jul. 18, 2002, now U.S. Pat. No. 6,684,551 which is a continuation-in-part of application Ser. No. 10/038,128, filed Jan. 2, 2002 now US. Pat. No. 6,678,987.

FIELD OF THE INVENTION

The present invention relates to a gunsight system for a firearm allowing faster target acquisition and providing a more precise aiming point. More particularly, the system utilizes a plurality of light gathering means to accurately define an aiming point while providing immediate target acquisition.

BACKGROUND OF THE INVENTION

During the years, firearm sights have been improved consistently to provide a user more accuracy under nearly all conditions. The use of reflective materials, light-gathering flourescent fibers and fiber optics have been utilized to design highly visible gun sights under all conditions, including low-light.

U.S. Pat. No. 5,878,503 (the '503 Patent) to Howe et al., and assigned to the assignee of the present application, discloses a high visibility gun sight system for detachable mounting on a gun barrel. The system uses a light-gathering plastic rod to provide a highly visible gun sight in low light conditions. As taught by the '503 Patent, the gun sight system, including the plastic rod, is mounted on an upper surface of a gun barrel in line with a raised bead sight normally manufactured near a distal end of the gun barrel. The plastic rod thereby instantly attracts a user's focus under circumstances that the raised bead will not.

U.S. Pat. No. 5,638,604 (the '604 Patent) to Lorocco discloses various configurations of sighting devices for projectile type weapons. Each design configuration employs light-gathering flourescent fiber to gather and amplify natural light. In one embodiment illustrated in FIG. 14 of the '604 Patent, three individual light-gathering fibers form a sight plane for aiming within a scope housing. Set screws permit said light-gathering fibers to be adjusted within the scope housing.

While the '503 and '604 Patents disclose useful gun sights, the need exists to implement a gun sight system, for all firearms most notably a shotgun with a ventilated ribbed barrel, able to accurately define an aiming point while allowing immediate target acquisition. The present invention utilizes a front and rear sight each including light-gathering means to define a precise aiming point providing immediate target acquisition. Triangular ends of said light-gathering means viewable by a user clearly define an aiming point.

SUMMARY OF THE INVENTION

The system of the present invention includes a rear and front sight each having colored light-gathering means as known in the art. Said front sight comprises a base member, retaining an elongated light-gathering rod, mounted to a gun barrel spaced from a muzzle end of said gun barrel. One end of said light-gathering rod viewable by a user is in the shape of a triangle directed upward.

The rear sight comprises a housing, with a retaining member for retaining an oval-shaped light-gathering rod with two ends, mounted to the gun barrel spaced rearward of said front sight. Said ends of the oval-shaped pipe define an aiming plane within a void bounded by said housing. Each end of the oval-shaped pipe viewable by the user is formed in the shape of a triangle in planar alignment with one another.

The front and rear sights are aligned such that the three pipe triangles define a precise aiming point for the user. From the user's perspective, an upper point of the front triangle aligned flush with an imaginary line joining the rear triangles results in an accurate shot. However, both the front and rear sights include adjustable means to implement the most accurate configuration and alignment of triangles considering all circumstances.

Two methods for improving the effectiveness of the light-gathering means, and therefore the gun sight system, have further been developed. A first method provides a multi-colored light-gathering means and a second method provides a "hot-spot" within a viewable target acquisition surface of a light-gathering means.

A multi-colored light-gathering viewing surface is formed by separately fabricating two light-gathering halves of different colors. Preferably, the two halves are fabricated with commonly known injection molding techniques. For example, the front sight of the present invention having the triangular viewing surface can be formed with an orange base and a green apex area. An elongated upper portion is molded such that an under-surface is flat along its entire length. At a viewing end, the upper section includes a triangular portion that will form an apex area of a complete triangular viewing area. An elongated lower portion is molded such that an upper-surface is flat along its entire length. At a viewing end, the lower section includes a triangular portion, having a flattened top, that will form a base of the complete triangular viewing area. The flat surfaces of the upper section and lower section are then joined by ultrasonic welding techniques. The joining of the two halves forms a complete triangular viewing area at one end thereof. Alternative means for joining the halves, or any number of members, are possible without departing from the scope and spirit of the method.

BRIEF DESCRIPTION OF THE DRAWINGS

These and other features and advantages, will become better appreciated as the same becomes better understood with reference to the claims, specification and drawings wherein:

FIG. 7 is a perspective view of the rear sight retainer member of the present invention; and FIG. 8 is a rear view (from a user's perspective) of the present invention mounted on a ventilated ribbed gun barrel.

DETAILED DESCRIPTION

Figures 1, 5, 6:
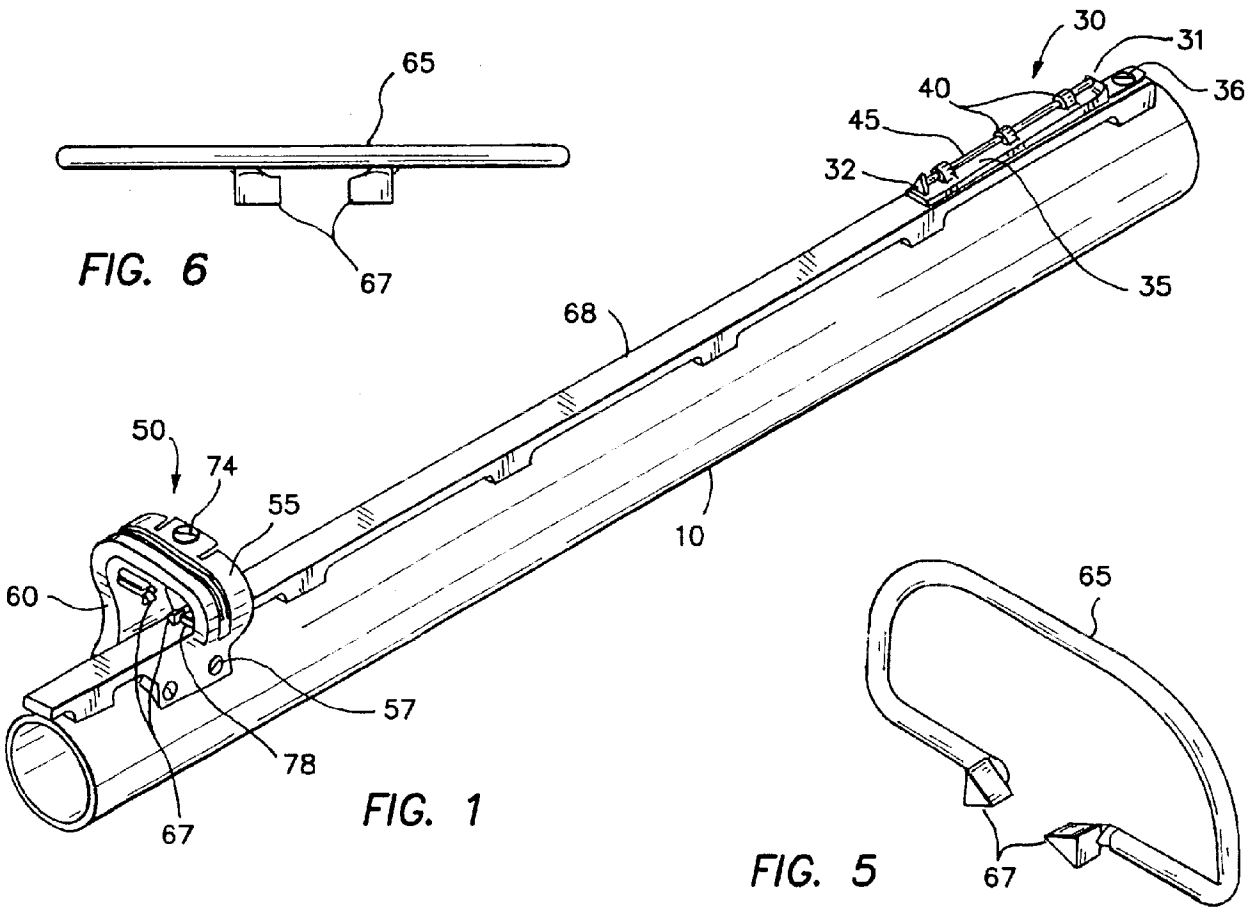
FIG. 1 is a perspective view of the present invention mounted on a ventilated ribbed gun barrel.
FIG. 5 is a perspective view of the rear gun sight light-gathering means.
FIG. 6 is a top view of the rear gun sight light-gathering means.
Figure 2:
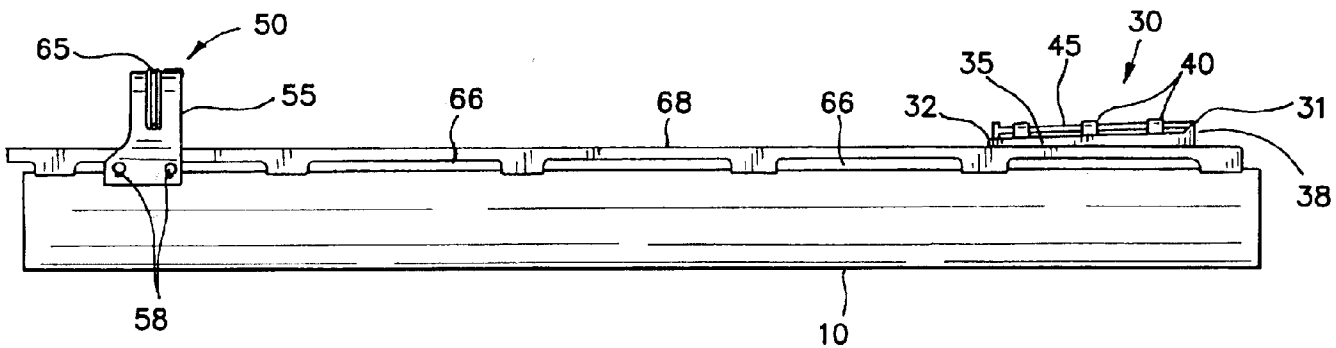
FIG. 2 is a side view of the present invention mounted on a ventilated ribbed gun barrel.
Figure 4:
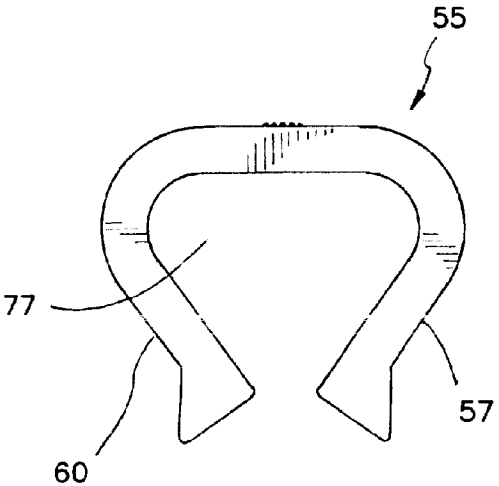
FIG. 4 is a rear view (from a user's perspective) of the rear gun sight housing.
Figure 3:
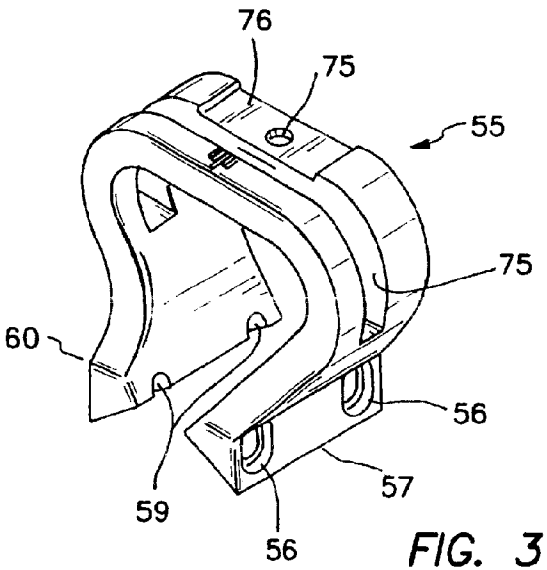
FIG. 3 is a perspective view of the rear gun sight housing of the present invention.

Reference is now made to the figures wherein like parts are referred to by like numerals throughout. FIGS. 1 and 2 show the present invention mounted on a gun barrel 10 including a front sight 30 and a rear sight 50. In a preferred embodiment, the sights 30, 50 are mounted to a ventilated rib 68 extending along a top edge of the barrel 10.

The front sight 30 includes a base member 35 having spaced stirrups 40 extending upwardly from an upper surface thereof. Said stirrups 40 define a longitudinal passage therethrough for detachably securing a first light gathering tube or rod means 45. Three stirrups 40 are spaced apart along the length of the plastic rod and positioned such that they hold and support the plastic rod in a plane parallel to the longitudinal axis of the gun barrel 10 and in proper alignment with the longitudinal axis of the barrel 10.

Said base member 35 is mounted to the top edge of the barrel 10, spaced from a front end thereof, by means of a screw 36 inserted through a base member opening 36, having a countersink to receive a head of the screw 36, and then inserted and tightened by means of screw 36 threads into the rib 68 securing the base member 35. A commercially available compound known as Loctite® my be used in conjunction with the screw 36 or double-sided tape may be applied along the underside of the base member 35 to further secure the base member 35.

Said base member 35 preferably slopes upward 1½° toward a front end of the base member 35. The slight slope is designed to prevent the pressure created by the attachment means at the front end of the base member 35 from forcing the rearward end of the base member 35 above the gun barrel 10. The slightest fluctuation in the position of the base member 35 will reduce the accuracy of the gun sight system.

In a preferred embodiment, the first light-gathering means 45 comprises a length of solid cylindrical colored plastic rod which is light-transparent. Preferably the exterior surface of the plastic rod is very smooth or polished. The forward end 31 of the plastic rod is preferably a sloped planer end. The rearward end or viewing end 32 of the plastic rod is triangular shaped and preferably has a planer surface which is a matte or slightly roughened surface.

The plastic rod can be formed from a variety of well-known plastics such as acrylics, nylon, polycarbonate, polystyrene, etc. in which a soluble colored dye is included. In general terms, any self-supporting light-transparent plastic may be used for this purpose.

Preferably the upper surface of the base member 35 includes a longitudinal recess or groove for guiding the plastic rod when the plastic rod is being slidably inserted beneath the stirrups 40 on the base member 35. A stop member 38 at a forward end of the base member 35 serves to prevent the plastic rod from being pushed too far forwardly on the base member. It also prevents the forward end of the plastic rod from catching or snagging on brush, weeds, twigs, etc.

Since the plastic rod is detachable from the base member 35, it is very easy to install different plastic rods whenever that is necessary or desirable. Different colored plastic rods may be more effective in differing light conditions. Further, different sized triangular viewing ends 32 of the plastic rod provide a means for adjusting the elevation of the front sight 30 to account for vertical firing inaccuracies. Therefore, the interchangeable rods are used to effectively calibrate the firing of the gun in a vertical plane.

Now referring to FIGS. 3, 4, 5, 6 and 7 the rear sight 50 comprises a housing 55, a retainer member 70 and a second light-gathering means 65. Said housing 55, including a first leg 57 and a second leg 60, defines a V-shaped void 77. Said first leg 57 includes two openings 56, spaced from a bottom surface thereof, having countersinks to receive heads of bolts 58 which extend through openings 56 and then through vents 66 of rib 68 and insert through corresponding openings 59 spaced from a bottom surface of the second leg 60 such that a nut may be applied thereto, causing said legs 57, 60 to detachably engage opposite sides of rib 68.

The second light-gathering means 65 is comprised of the same material, with the same properties, as the first light-gathering means 45 described above. However, the second light-gathering means 65 comprises a semi-oval plastic rod with two ends 67 each triangular in shape defining a planar space therebetween. The two triangular-shaped ends 67 project, when installed, in the rearward direction such that the ends 67 are offset from a plane defined by the semi-oval plastic rod. Without departing from the scope of the present invention, the ends 67 can also be implemented within the plane defined by the semi-oval plastic rod. In other words, it is not imperative that the ends "project" in the rearward direction but they need only face in the rearward direction. As with the first light-gathering means 45, viewable surfaces of ends 67 preferably have a planer surface which is a matte or slightly roughened surface.

Upon installation, said semi-oval plastic rod seats in groove 69 that traverses the perimeter of retaining member 70 that inserts into a recess 75 in the housing 55. The retaining member 70 has the overall shape of the semi-oval plastic rod such that, while seated in groove 69, the plastic rod circumscribes the retaining member 70. As required, the recess 75 allows a majority of the oval-shaped plastic rod to be exposed to light.

A rectangular planar surface 72 extending from an upper surface of said retaining member 70, includes an opening 73, having a countersink, for insertion of a screw 74 therethrough and into opening 75 in said housing thereby securing the retaining member 70 and the second light-gathering means 65 to the housing 55. The planar surface 72 is accommodated by a rectangular notch 76 on an upper surface of the housing 55. Said notch 76 has a greater length that the planar surface 72 allowing the retaining member 70 to be shifted laterally for reasons described hereinafter. To facilitate the lateral shift of the retaining member 70, said opening 73 is oval-shaped and larger than a head of screw 74 permitting screw 74 to be properly aligned with opening 75 even though the retaining member 70 may have been shifted laterally.

Now referring to FIG. 8, when mounted together, each end 67 of the oval-shaped plastic rod of the rear sight 50 extends into the V-shaped void 77 from opposite directions to define a planar space therebetween. Except for the triangular ends 67, the housing 55 and arms 78 of the retaining member 70 conceal the oval-shaped plastic rod from a rearward view so as to quickly focus a firearm user's attention to the triangular ends 67.

Besides protecting the oval-shaped plastic rod of the rear sight 50 from breakage, the retaining member 70 also allows for lateral shifting of the oval-shaped plastic rod. Further, lateral shifting of the oval-shaped plastic rod provides a means for accounting for horizontal firing inaccuracies. Therefore, the shifting means is used to effectively calibrate the firing of the gun in a horizontal plane.

From a firearm user's view, the two sights 30, 50 and their respective light-gathering means 45, 65 provide three viewable lighted triangular surfaces defining a precise aiming point. During use, the lighted triangles quickly draw the attention of a firearm user providing quick target acquisition and firing capability.

Figure 9:
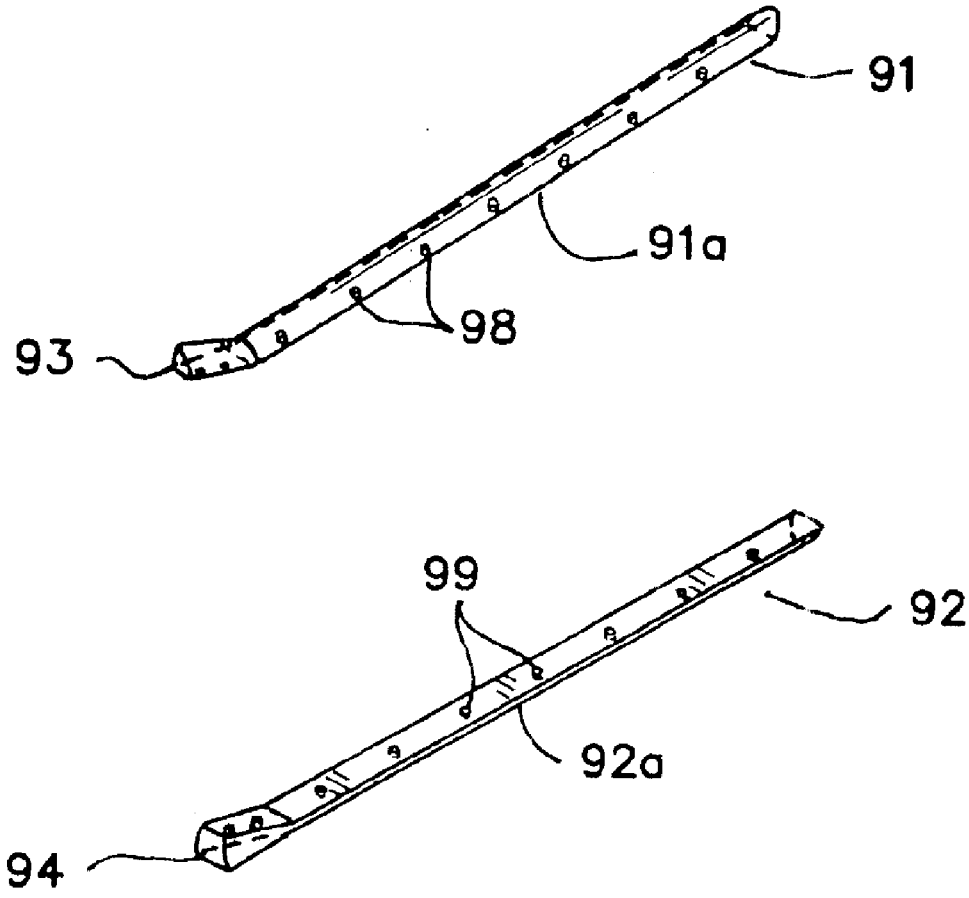
FIG. 9 is a perspective view of an upper section and lower section of a multi-colored light-gathering means used in a front sight of the present invention.
Figure 10:
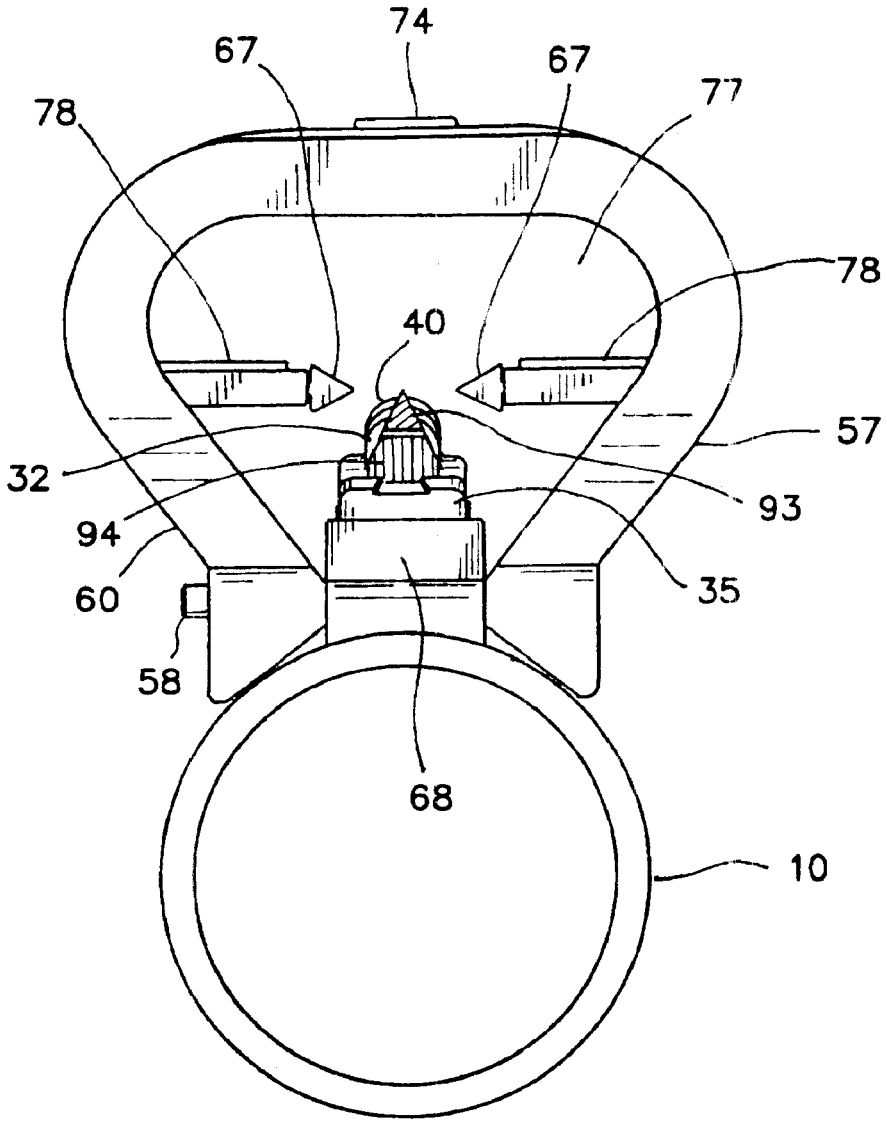
FIG. 10 is a rear view (from a user's perspective) of the multi-colored light-gathering means of the front sight.

FIG. 9 shows an upper section 91 and lower section 92 of a multi-colored light-gathering means prior to their combination. The upper section 91 and lower section 92 have partial semi-circular cross-sections and are fabricated of a different colored light-gathering means. The sections 91, 92 are preferably fabricated using known injection molding techniques. The viewing end of the upper section 91 includes a triangular portion 93 which forms an apex area of a complete viewing area upon the integration of the two sections 91, 92. The upper section 91 has a substantially flat bottom 91*a*. The lower section 92 includes a generally triangular shaped end 94 which forms the base portion of the complete triangular viewing end of a gun sight. The lower section 92 has a substantially flat top 92*a*. To facilitate connection, the flat bottom 91*a* includes a plurality of spaced projections 98 and the flat top 92*a* includes a plurality of spaced cavities 99 for receipt of the projections 98. Now referring to FIG. 10, the flat sections 91*a*, 92*a* are joined by inserting said projections 98 into said cavities 99 and exposing the joined sections 91, 92 to ultrasonic welding techniques. The two joined sections 91, 92 provide a multi-colored triangular viewing portion for a user. Alternatively, the two sections 91, 92 can be joined using an adhesive.

Both the upper section 91 and the lower section 92 transmit light along their lengths to the viewing end. In this arrangement, the triangular viewing area 32 attracts the user's eyes and the triangular portion 93 immediately focuses the user's eyes on an intended target. For example, the lower section triangle shape 94 may be colored orange and the triangular portion 93 may be colored green whereby the orange quickly attracts the user's eyes which then immediately focus on the green apex 93. Any gun sight viewing shape (e.g. circle formed of two semi-circles) can be formed utilizing the method described herein. The multi-colored light-gathering means is ideal for the front gun sight 30 of the present invention.

A hot-spot within a viewing end of a light-gathering means is achieved by properly angling specific surfaces of the light-gathering means. Again, injection molding techniques are the preferred procedure for fabricating the light-gathering means having a hot-spot. For example, the rear sight 50 having two triangular viewing surfaces 67 can be formed such that an apex, or any portion, of the triangular viewing surfaces 67 are brighter than the remaining portions of the triangular viewing surfaces 67.

Figure 11:
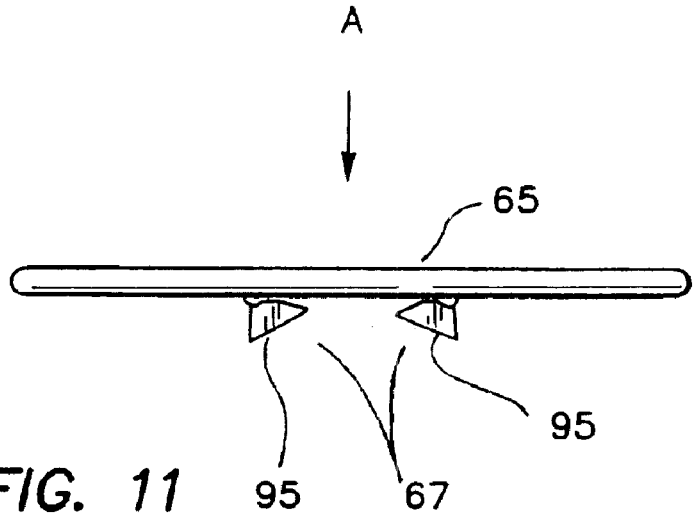
FIG. 11 is a top view of a light-gathering means having a hot-spot and used in the rear gun sight of the present invention.
Figure 12:
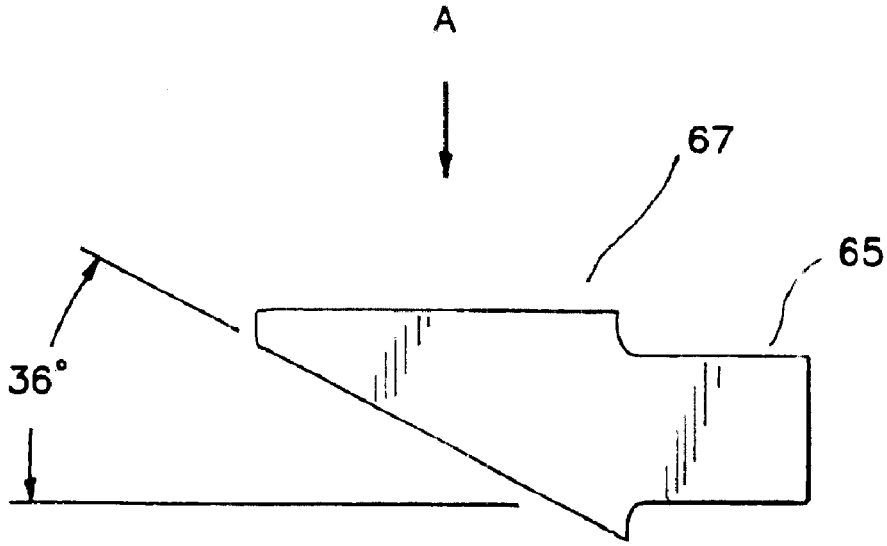
FIG. 12 is a close-up bottom view of a triangular viewing portion of the light-gathering means having a hot-spot used in the rear gun sight of the present invention.
Figure 13:
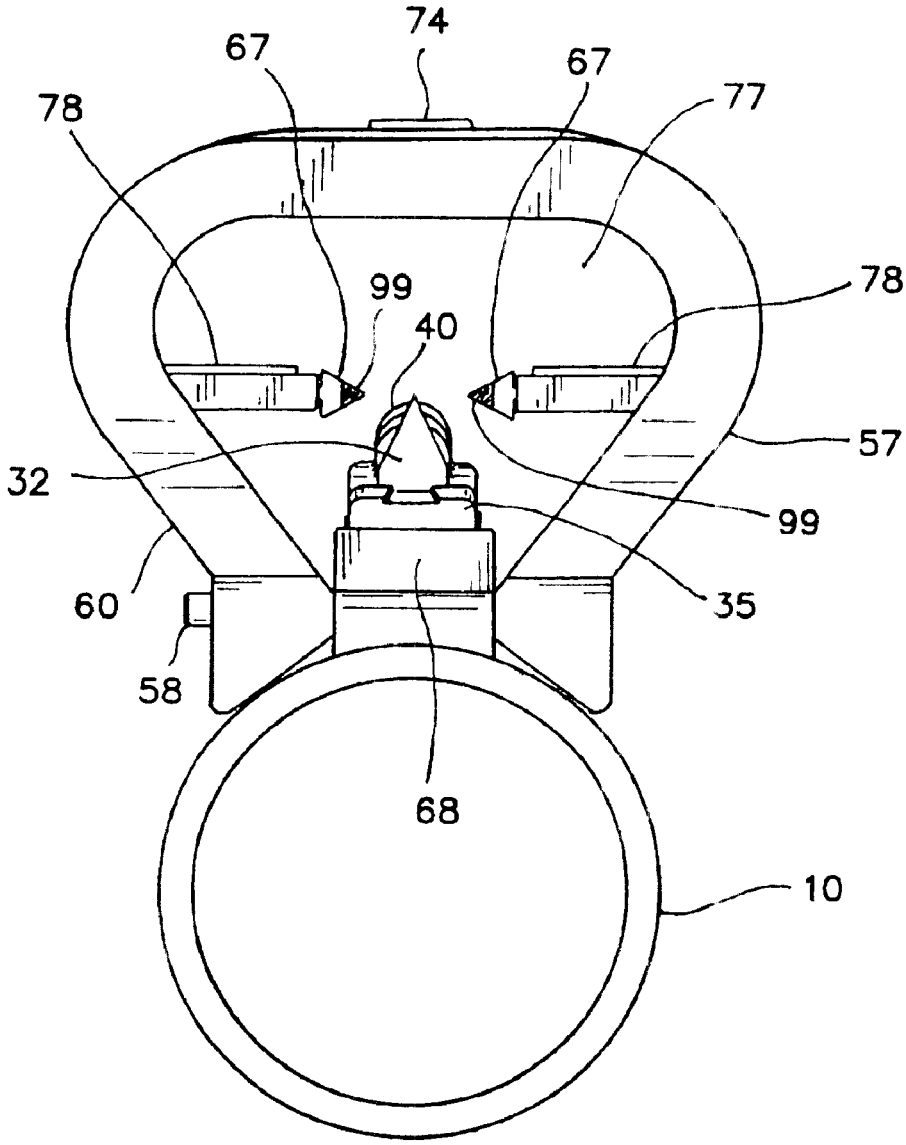
FIG. 13 is a rear view (from a user's perspective) of the light-gathering means including the hot-spot in the rear sight of the present invention.

FIG. 11 shows a top view of the rear light-gathering means 65 of the rear gun sight 50 having two triangular viewing surfaces 67. When implemented the user will view the rear light-gathering means 65 in the direction of arrow A. Angled surfaces 95 cause the light transmitted by the light-gathering means 65 to focus at a common location 99 as seen in FIG. 13. FIG. 12 shows a preferred angle of 36°. Other angles may be used, but angles near the preferred angle of 36° maximize the effect. FIG. 13 shows a user's view of the rear light-gathering means 65 including the "hot-spots" 99. In reality, the "hot-spots" 99 are brighter than the other portions of the triangular viewing areas. The hot-spot technology may also be used in conjunction with the multi-colored light-gathering means. Therefore, in the previous example, the green triangular portion 93 may further include a hot-spot at the apex.

In a preferred embodiment, the present invention is designed to hunt turkey. The turkey's frame is unique in that the head is remotely located from the turkey's body by an elongated neck. Turkey hunters desire to kill turkeys with head shots and therefore require a gun sight with supreme accuracy. Turkeys rarely remain still further requiring means to quickly acquire precise aim on the turkey's head. The present invention provides the needed accuracy and immediate target acquisition necessary to effectively hunt turkeys. While well-suited for turkey hunting, the gun sight system disclosed herein is effective for hunting all varieties of game.

Although the gun sight system is shown implemented on a ventilated ribbed barrel 10, it is to be understood that the gun sight system of the present invention is equally efficient with all firearms, including those with non-ribbed barrels. Moreover, the base member 35, housing 55 and the retainer member 70 are preferably fabricated of nylon but said components may be fabricated of any plastic, metal, alloy, polymer, etc.

Although the invention has been described in detail with reference to the preferred embodiment, additional variations and modifications exist within the scope and spirit of the invention as described and defined in the following claims.

I claim:

1. A gun sight member including:

a light-gathering means having a viewing end including a viewing surface, said viewing end shaped to concentrate a substantial amount of gathered light to only a portion of the viewing surface.

2. The gun sight member of claim 1 wherein said gathered light is concentrated at the apex of a triangular viewing surface.

3. The gun sight member of claim 2 where in a back surface of the viewing end is sufficiently angled to cause the gathered light to concentrate at the apex.

4. The gun sight member of claim 3 wherein the back surface is angled about thirty six degrees in relation to the viewing surface.

5. The gun sight member of claim 1 wherein the light-gathering means comprises a length of solid cylindrical colored plastic which is light-transparent.

6. A gun sight member comprising:

a elongated base member mounted to a gun barrel spaced from a muzzle end of said gun barrel, said base member detachably securing an elongated first light-gathering means having a triangularly shaped rearward viewing end, said viewing end shaped to concentrate a substantial amount of gathered light to only a portion of a viewing surface.

7. A gun sight member comprising:

a housing defining a void therethrough, a retainer member and a light-gathering means, said housing mounted to said gun barrel spaced rearwardly from a gun barrel opening, whereby said light-gathering means is removably mated with the retainer member, said retainer member and mated light-gathering means secured within a recess of said housing whereby two rearward facing triangularly shaped ends of the light-gathering means extend into the housing void wherein said triangularly shaped ends are shaped to concentrate a substantial amount of gathered light to only a portion of a viewing surface.

8. A gun sight system defining an aiming point comprising:

a front sight having an elongated base member mounted to a gun barrel spaced from a muzzle end of said gun barrel, said base member detachably securing an elongated first light-gathering means having a triangularly shaped rearward viewing end wherein gathered light is concentrated at an apex of the triangularly shaped rearward viewing end; and a rear sight having a housing defining a void therethrough, a retainer member and a second light-gathering means, said housing mounted to said gun barrel spaced rearwardly from said front sight, whereby said second light-gathering means is removably mated with the retainer member, said retainer member and mated second light-gathering means secured within a recess of said housing whereby two rearward facing triangularly shaped ends of the second light-gathering means extend into the housing void wherein said triangularly shaped ends are shaped to concentrate a substantial amount of gathered light to only a portion of a viewing surface.

* * * * *